US009459064B1

(12) United States Patent
Xu

(10) Patent No.: US 9,459,064 B1
(45) Date of Patent: Oct. 4, 2016

(54) MULTIFUNCTIONAL AND DETACHABLE TRIGGER SAFETY DEVICE FOR A FIREARM

(71) Applicant: Ye Xu, Sugar Land, TX (US)

(72) Inventor: Ye Xu, Sugar Land, TX (US)

( * ) Notice: Subject to any disclaimer, the term of this patent is extended or adjusted under 35 U.S.C. 154(b) by 0 days.

(21) Appl. No.: 14/927,661

(22) Filed: Oct. 30, 2015

(51) Int. Cl.
*F41A 17/54* (2006.01)

(52) U.S. Cl.
CPC ..... *F41A 17/54* (2013.01)

(58) Field of Classification Search
CPC ..... F41A 17/46; F41A 17/52; F41A 17/54; F41A 17/22
See application file for complete search history.

(56) References Cited

U.S. PATENT DOCUMENTS

| | | | | |
|---|---|---|---|---|
| 6,389,726 | B1 * | 5/2002 | Bentley | F41A 17/54 42/70.06 |
| 9,097,479 | B1 | 8/2015 | Barido et al. | |
| 2014/0182180 | A1 * | 7/2014 | Murphy, II | F41A 17/54 42/70.07 |

FOREIGN PATENT DOCUMENTS

| | | | |
|---|---|---|---|
| WO | WO 2014/182698 | * | 11/2014 |

* cited by examiner

*Primary Examiner* — Stephen M Johnson
(74) *Attorney, Agent, or Firm* — Benjamin Aaron Adler

(57) ABSTRACT

Provided are detachable trigger safety devices for a gun configured to conveniently lock/unlock the trigger. Generally, the trigger safety device comprises a first component, a second component and means for releasably limiting the positions of the second component. The first component is attached to the barrel portion of a gun. The second component is either hingedly attached to the first component or slidably attached to the out surface of the first component. When the second component is hinged to the first component, the second component rotates upward to enclose the trigger. When the second component is slidably attached to the first component, a set of grooves on the inner surface of the second component corresponds to the rails disposed on the out surface of the first component such that the second component is slidable along the length of the first component.

20 Claims, 10 Drawing Sheets

MULTIFUNCTIONAL AND DETACHABLE TRIGGER SAFETY DEVICE FOR A FIREARM

BACKGROUND OF THE INVENTION

1. Field of the Invention

The present invention generally relates to the field of firearm accessories. More specifically, the present invention relates to a multifunctional and detachable trigger safety device to a firearm.

2. Description of the Related Art

Firearms are often equipped with limited safety features for protecting users from unintentional gunshots. For instance, revolvers and semi-auto handguns like Glock handguns are designed with no extra safety structures other than a heavy pull on triggers, or an internal trigger safety device. In many scenarios, this could pose significant risk to the user's safety.

When a handgun is carried in a concealed fashion, handguns are often kept in users' pockets or bags without holsters, along with items such as keys, lipsticks, and pens. These items could be accidently inserted into trigger guards and result in unintentional trigger fire. Even when handguns are held in holsters, they could still be accidentally fired while being removed or inserted into the holsters. Furthermore, triggers of handguns could also be unintentionally pulled by children, or an unauthorized person in a home environment.

Therefore, many external safety devices have been developed over the years to provide extra safety features that prevent unauthorized or unintended accesses to the triggers. For example, a detachable gun trigger safety device was developed to attach to the rear housing of a gun trigger guard, spanning between a gun trigger and the rear portion of the trigger guard to stop the trigger moving backwards. Similar trigger safety devices include a shackle that directly inserts though the trigger guard and prevents triggers from actuating. Other trigger safety devices include triggers with a body design to self-conform to, or affix to the trigger guards with structures to enable trigger safety devices rotating between on and off positions. Another trigger safety device is inserted to a handgun stock. This trigger safety device can be released by actuating a first and a second lever, which are located on opposite sides of the handgun.

However, these external trigger safety devices generally require several steps to be dismissed before the gun can be used to fire. Many external trigger safety devices require coordination of several fingers to remove. This is inconvenient especially when a handgun is needed urgently. Moreover, many of these trigger safety devices occupy a large portion of handguns, defeating the purpose of the portability of using a handgun and hindering the use of other accessories on it.

Therefore, there is a recognized need in the art for a gun trigger safety device that engages and disengages a gun trigger with a single movement and provides multiple functions of other accessories at the same time. Particularly, the prior art is deficient in these aspects. The present invention fulfills this long standing need and desire in the art.

SUMMARY OF THE INVENTION

The present invention is directed to a detachable trigger safety device for conveniently covering a gun trigger. The trigger safety device comprises a first component, a second component and means for releasably limiting positions of the second component. The first component comprises a body portion and a mount, which is attachable to a gun barrel.

The present invention is further directed to a slidable trigger safety device for a gun. The trigger safety device comprises a first component, a second component, a sliding mechanism for the second component to slide along the length of the gun barrel, and means for releasably limiting positions of the second component. The first component comprises a body portion with a set of rails disposed on the side surfaces thereof and a mount disposed on the body portion. The second component is slidably attached to the first component in a removably covering relationship with a gun trigger.

The present invention is further directed to a swivelable trigger safety device for a gun. The trigger safety device comprises a first component, a second component and means for releasably limiting the position of the second component. The first component comprises a body portion and a mount disposed on the body portion. The second component is hingedly attached to the first component in a covering relationship with a gun trigger. The means for releasably limiting the position of the second component are used to lock the second component in a covering relationship with the gun trigger.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE INVENTION

Figure 1:
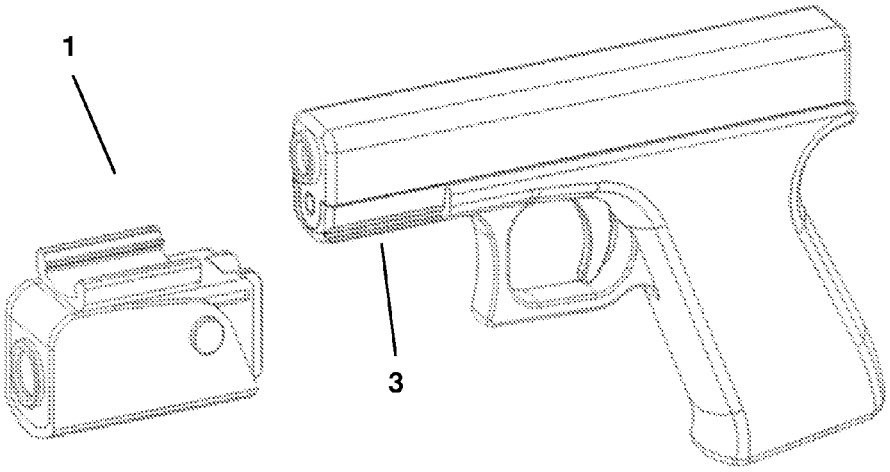
FIG. 1 is a perspective view of a trigger safety device detached from a handgun.
Figure 2:
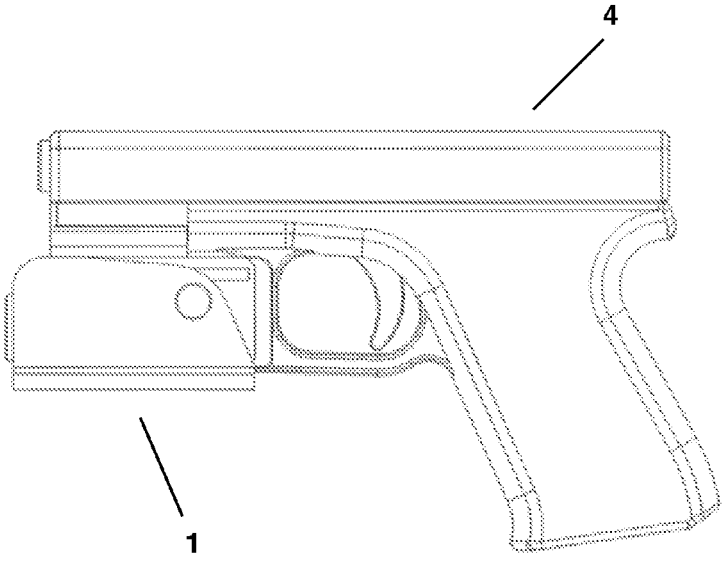
FIG. 2 is a front view of the trigger safety device attached on a handgun.
Figure 3:
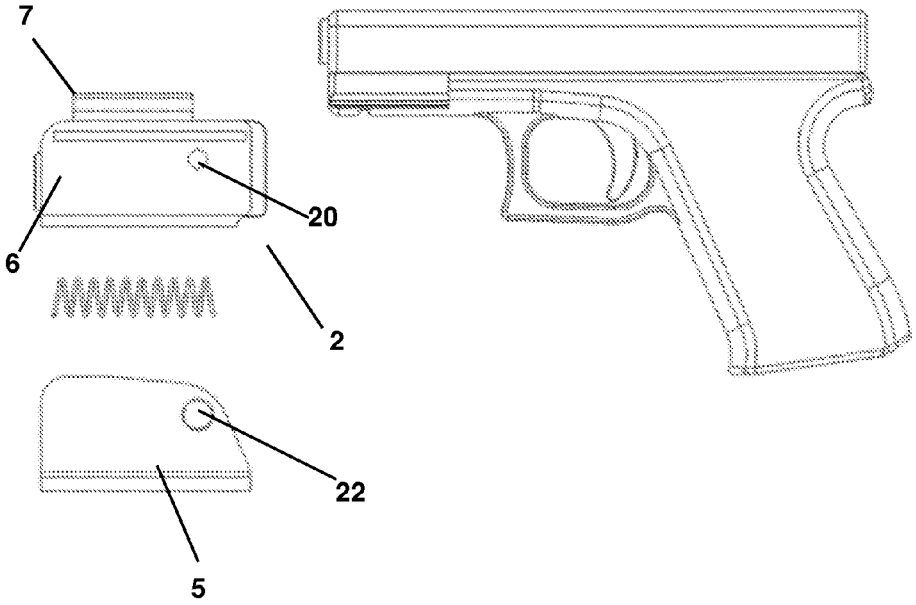
FIG. 3 is an exploded view of the major parts of a trigger safety device of the present invention.
Figure 4:
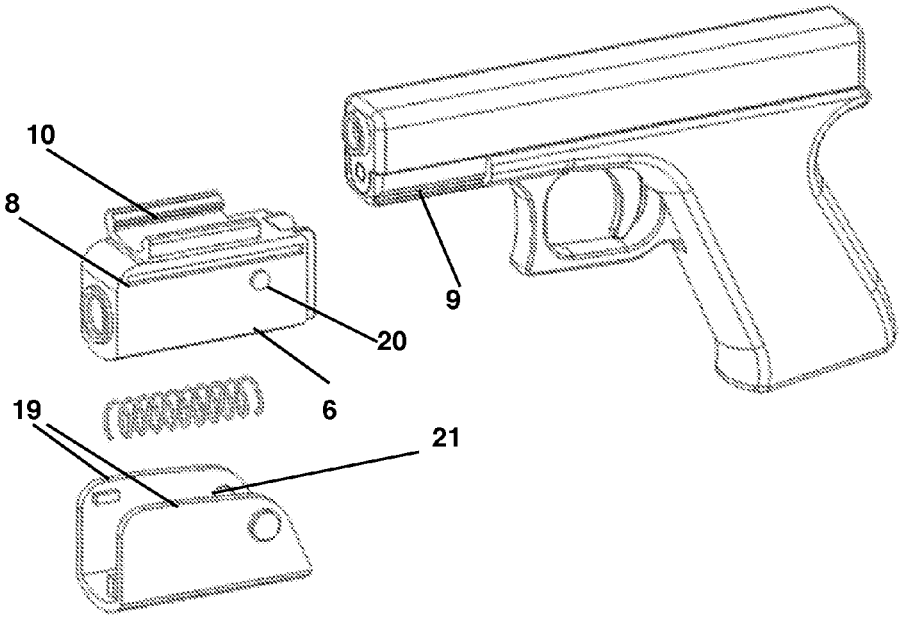
FIG. 4 is an exploded view from the front for major parts of a trigger safety device detached from the handgun.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

As used herein, the term "distal end" refers to an end that is distal from a handle of a gun. The term "proximal end" refers to an end that is proximal from a handle of a gun.

As used herein, the term "firearm" is interchangeable with the term "gun" or "handgun" as is known in the art.

In one embodiment of the present invention, there is provided a trigger safety device for covering a gun trigger. The trigger safety device comprises a first component removably attached to a gun barrel comprising a body portion and a mount disposed thereon; a second component movably attached to the first component in a removably covering relationship with the gun trigger; and means for releasably limiting positions of the second component.

In this embodiment, the mount of the first component comprises a bottom surface in a covering relationship with the bottom of a gun barrel, two side surfaces and a fastening structure configured to secure the mount to the gun barrel. Representative examples of the fastening structure include, but are not limited to, one or more grooves within which the rails on the gun barrel slide, one or more projections, one or more rails on the first component, which the rails on the gun barrel engage, one or more screw holes on mount, known to one having ordinary skill in this art or a combination thereof.

Preferably, the fastening structure may further comprise a mounting assembly comprising a groove in a wrapping relationship with a front portion of a trigger guard and affixed thereto.

In a preferred embodiment, when the fastening structure is one or more screw holes, and the mount is affixed to the gun via the screw holes.

In yet another preferred embodiment, the device further comprises a belt clip. More preferably, the belt clip is affixed to the first component of the device.

In one aspect of the embodiment, the trigger safety device may further comprise a sliding mechanism such that the second component is slidably on the first component along the length thereof. In this embodiment, the sliding mechanism may comprise one or more rails and grooves combinations disposed on one or more side surfaces of the first component and one or more inner surfaces of the second component.

Alternatively, the means for limiting positions of the second component also comprises of at least one pre-defined part, wherein the pre-defined part, such as rails, grooves, holes, or projections, are formed on the first and/or second component; and, the second component can be secured into and released from the pre-defined part. By altering arrangements wherein the second component securing into the pre-defined parts, the second component can be locked in a covering relationship either with the first component or the gun trigger; and by releasing the second component from the pre-defined parts, the second component is allowed to move relatively against the first component. The configurations, arrangements, and numbers of the second component and the pre-defined parts are known to those having ordinary skills in the art.

According to one embodiment of the current invention, the means for limiting positions of the second component comprise at least one compressible position limiting rod disposed at the proximal end of the first component; one or more openings disposed on the distal and proximal ends of the second component; and one or more buttons disposed over these openings and affixed on the outer surface of the second component, configured to compress the compressible position limiting rod and release the second component, wherein the position limiting rod aligns with the openings on the distal end of the second component to lock the second component in a covering relationship with the gun trigger; the position limiting rod aligns with the openings on the proximal end of the second component to lock the second component in a covering relationship with the first component.

In another aspect of the embodiment, the second component of the trigger safety device is a swivelable part hingedly attached to the first component. In this aspect of the embodiment, the means for releasably limiting positions comprise one or more compressible position limiting rod and disposed at the proximal end of the first component, spanning through the depth thereof; one or more openings disposed on the distal end of the second component of the trigger safety device; and one or more buttons disposed over these openings and affixed on the outer surface of the second component configured to compress the compressible position limiting rod and release the second component, wherein the position limiting rod aligns with the openings on the distal end of the second component to lock the second component in a covering relationship with the trigger.

In another embodiment of this invention, there is provided a slidable trigger safety device. This slidable trigger safety device comprises a first component removably attached to a gun barrel comprising a body portion with a set of rails disposed on the side surfaces thereof and a mount disposed thereon; a second component slidably attached to the first component in a removably covering relationship with a gun trigger; a sliding mechanism for the second component to slide one the first component along the length thereof; and means for releasably limiting positions of the second component. In this embodiment, the sliding mechanism comprises one or more rails and grooves combinations disposed on the side surfaces of first component and inner surface of the second component.

In a preferred embodiment, the mount of the first component comprises a bottom surface in a covering relationship with the bottom of a gun barrel and two side surfaces and a fastening structure configured to secure the mount to the side surfaces of the gun barrel.

Representative examples of the fastening structure include, but are not limited to, one or more grooves within which the rails on the gun barrel slide, one or more projections, one or more rails on the first component which the rails on the gun barrel engage, screw holes on the first component, strips, or a combination thereof. In a preferred embodiment, when the fastening structure is one or more screw holes, a belt clip and mount is affixed to the gun via the one or more screw holes. In this embodiment, the fastening structure may further comprise a mounting assembly comprising a groove in a wrapping relationship with a front portion of a trigger guard and affixed thereto.

In this embodiment, the means for limiting positions of the second component comprise a compressible position limiting rod disposed at the proximal end of the first component, spanning through the depth thereof; one or more openings disposed on the distal and proximal ends of the second component of the trigger safety device; and one or more buttons disposed over these openings and affixed on the outer surface of the second component configured to compress the compressible position limiting rod and release the second component, wherein the position limiting rod aligns with the openings on the distal end of the second component to lock the second component in a covering relationship with the trigger, the position limiting rod aligns with the openings on the proximal end of the second component to lock the second component in a position to access the trigger.

In another embodiment of the present invention, there is provided a swivelable trigger safety device. The swivelable trigger safety device comprises a first component removably attached to a gun barrel comprising a body portion and a mount disposed thereon; a second component hingedly attached to the first component in a removably covering relationship with a gun trigger; and means for releasably limiting the second component in a covering relationship with the gun trigger.

In this embodiment, the mount of the first component comprises a bottom surface in a covering relationship with the bottom of a gun barrel and two side surfaces, and a fastening structure configured to secure the mount to the gun barrel.

Representative examples of the fasten structure include, but are not limited to, one or more grooves within which the rails on the gun barrel slide, one or more projections, one or more rails which the rails on the gun barrel engage, screw holes on the first component, strips or a combination thereof. In a preferred embodiment, when the fastening structure is one or more screw holes, a belt clip and mount is affixed to the gun via the on or more screw holes. In this embodiment, the fasten structure may further comprise a mounting assembly comprising a groove in a wrapping relationship with a front portion of a trigger guard and affixed thereto.

In this embodiment, the means for releasably limiting the second component comprise a compressible position limiting rod and disposed at the proximal end of the first component, spanning the depth thereof; one or more openings disposed on the distal end of the second component of the trigger safety device; and one or more buttons disposed over these openings and affixed on the outer surface of the second component configured to compress the compressible position limiting rod and release the second component, wherein the position limiting rod aligns with the openings on the distal end of the second component to lock the second component in a covering relationship with the gun trigger.

Provided herein is a trigger safety device to conveniently cover and uncover gun triggers. Generally, there are several configurations of the trigger safety devices of the present invention. One configuration is a slidable trigger safety device 1 (FIGS. 1-7 and 15-18). This trigger safety device comprises a first component 2 that mounts on to a barrel 3 of a gun 4, a second component 5 that can be slidably connected on the first component, and means for limiting positions of the second component. The first component comprises a body portion 6 and a mount portion 7 that affixed on top of the body portion. A set of rails 8 is formed on the top and/or bottom edge of the left and right sides of the body portion. The configuration of the mount portion depends on the structure of the gun barrel. For guns that have standard Picatinny rails 9 on the left and right sides of the barrel, the mount can be a simple holder attached to the bottom part and left and right sides of the barrel with grips 10 into which the Picatinny rails fit, securing the first component on to the gun. In this configuration, the trigger safety device can be easily slid onto the gun.

Figure 8:
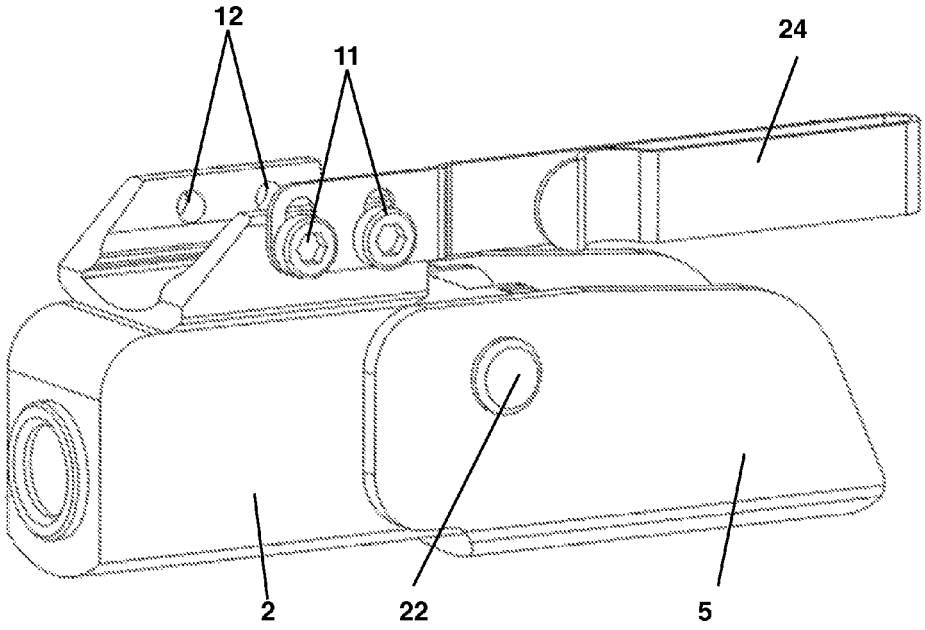
FIG. 8 is a perspective view of a swivelable trigger-lock with an extra securing assembly in the present invention.
Figure 9:
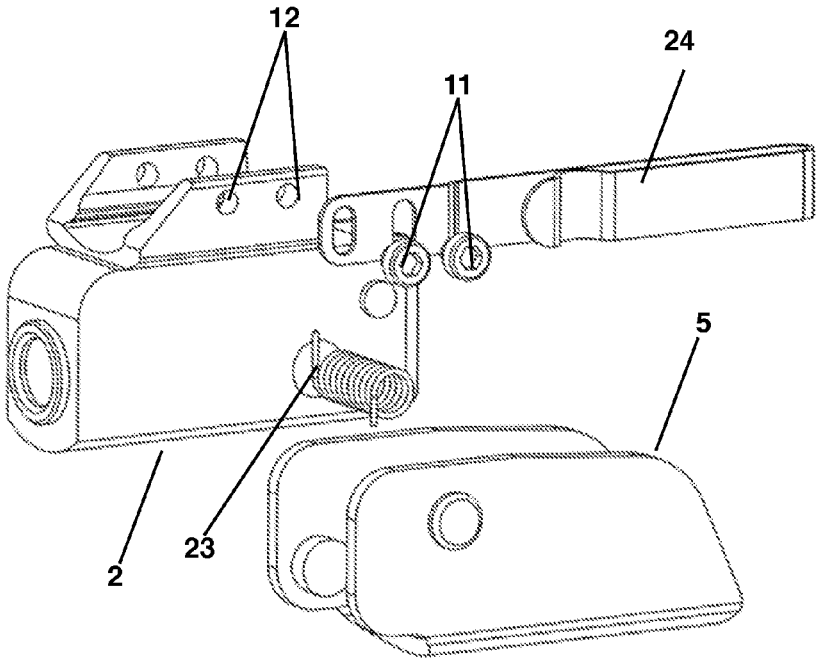
FIG. 9 is an exploded view of a swivelable trigger-lock with an extra securing assembly in the present invention.
Figure 10:
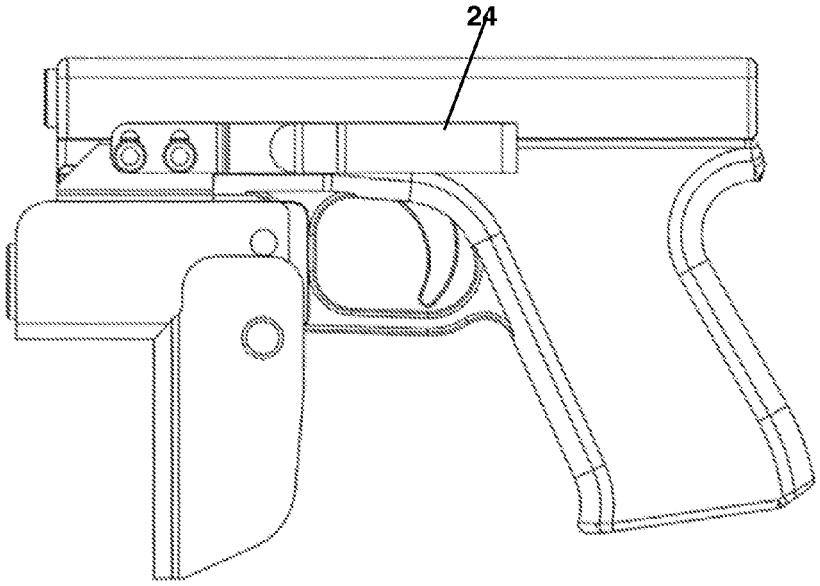
FIG. 10 is a front view of a swivelable trigger-lock with an extra securing assembly attached on a handgun and in an unlocked position.
Figure 11:
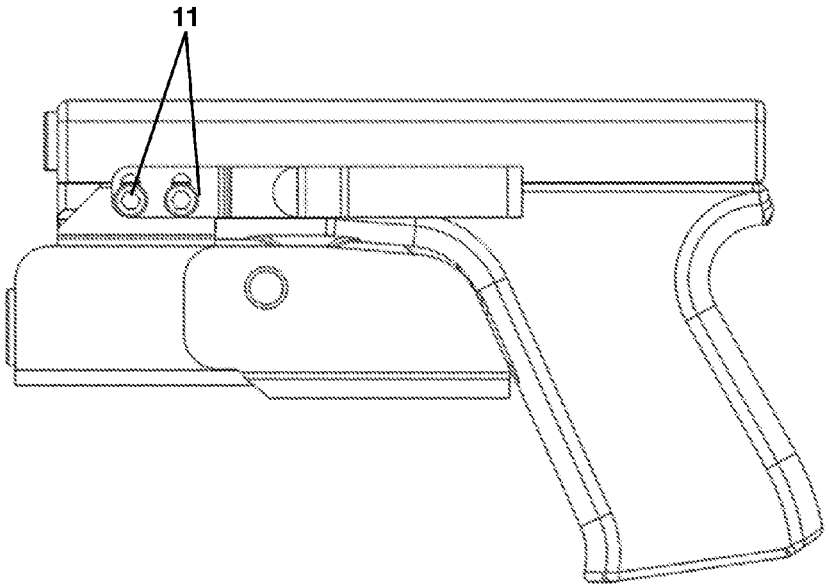
FIG. 11 is a front view of a swivelable trigger-lock with an extra securing assembly attached on a handgun in a locked position.
Figure 12:
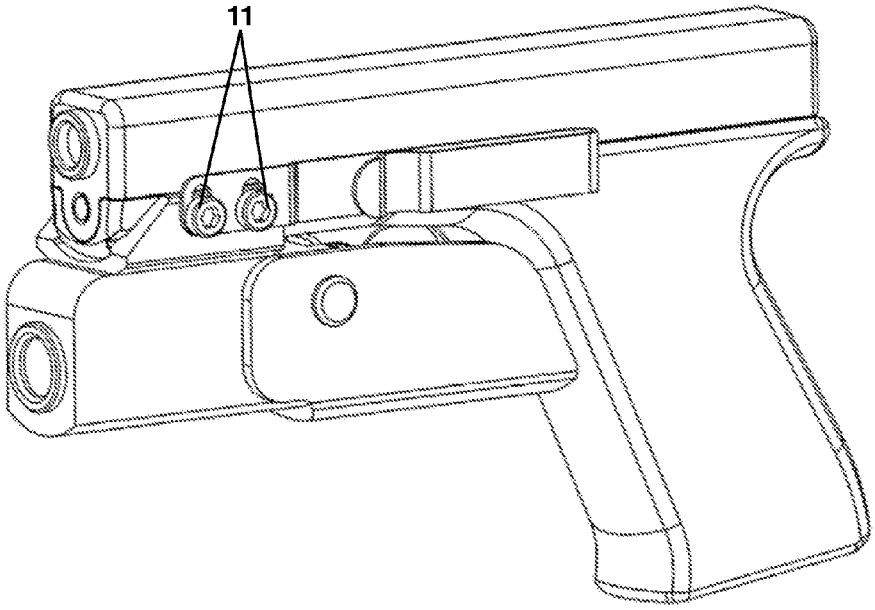
FIG. 12 is a perspective view of the swivelable trigger-lock attached on a handgun in a locked position.
Figure 13:
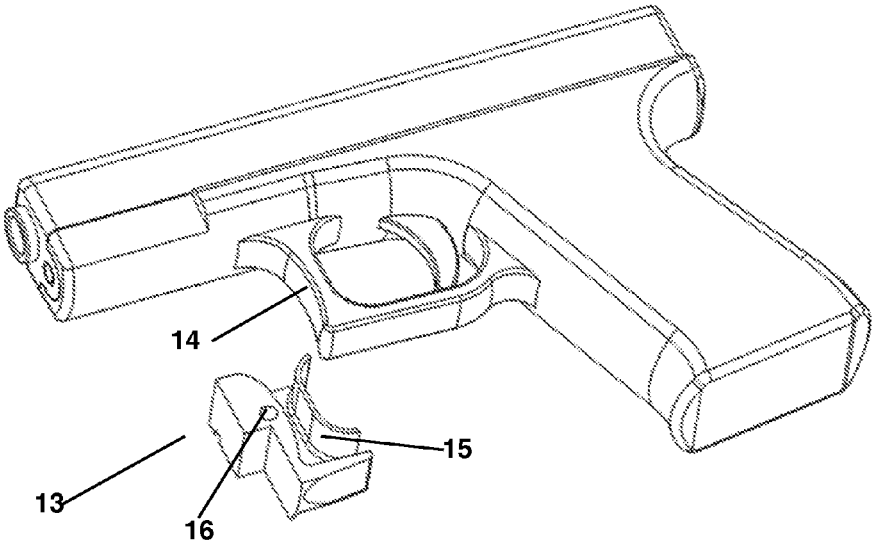
FIG. 13 is a perspective view showing the mounting assembly detached from the trigger guard. This mounting assembly is configured to secure the rotating trigger-lock on the handgun.
Figure 14:
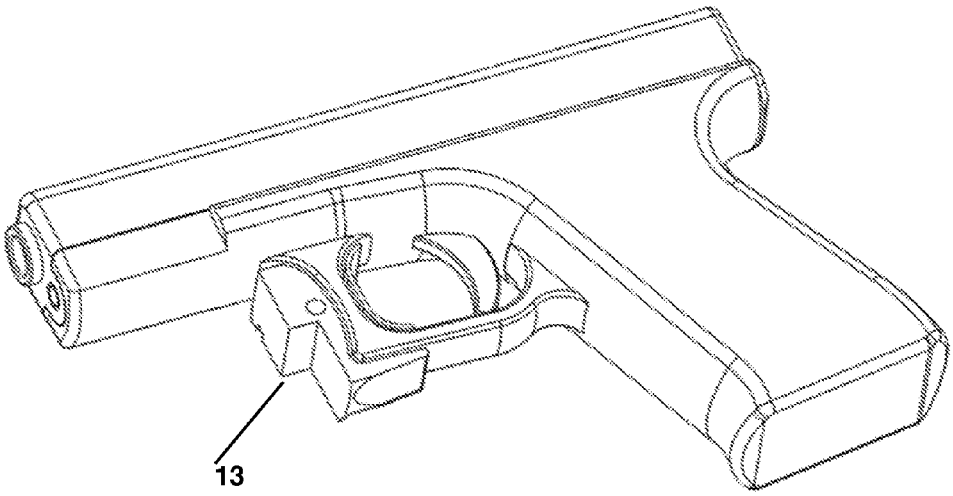
FIG. 14 is a perspective view showing the mounting assembly attached to the trigger guard. This mounting assembly is configured to secure the rotating trigger-lock on the handgun.
Figure 15:
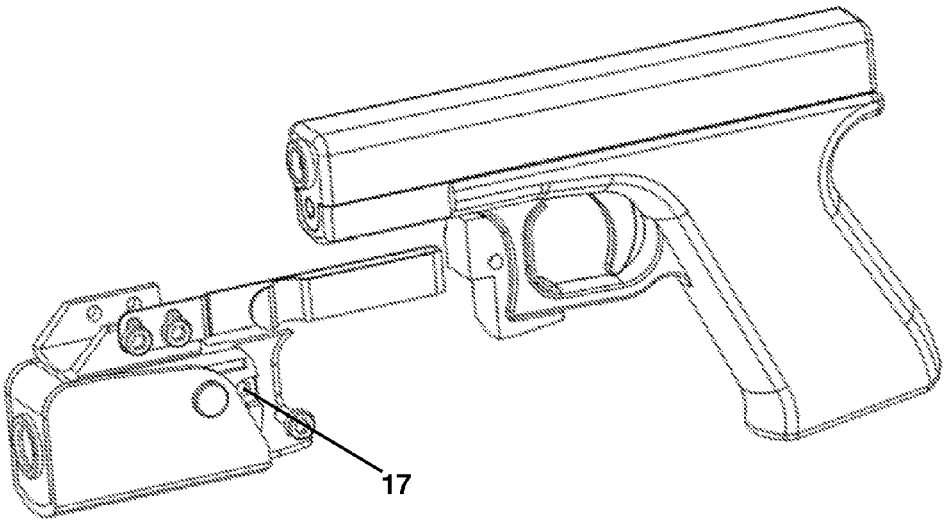
FIG. 15 is a perspective view showing the mounting assembly attached to the trigger guard and the trigger safety device is detached from the handgun. This mounting assembly is configured to secure the trigger safety on the handgun.
Figure 16:
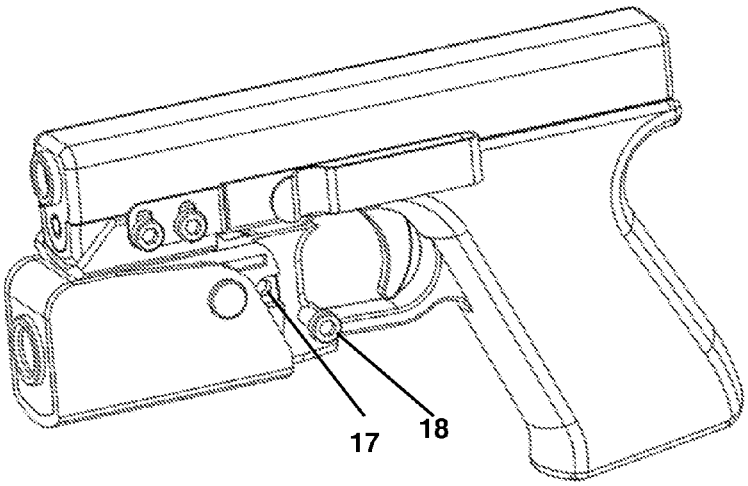
FIG. 16 is a perspective view showing the mounting assembly attached to the trigger guard and the trigger safety device is attached to the handgun in the position exposing the trigger. This mounting assembly is configured to secure the swivelable trigger safety device on the handgun. In this figure, the securing screw for the mounting assembly is unscrewed.
Figure 17:
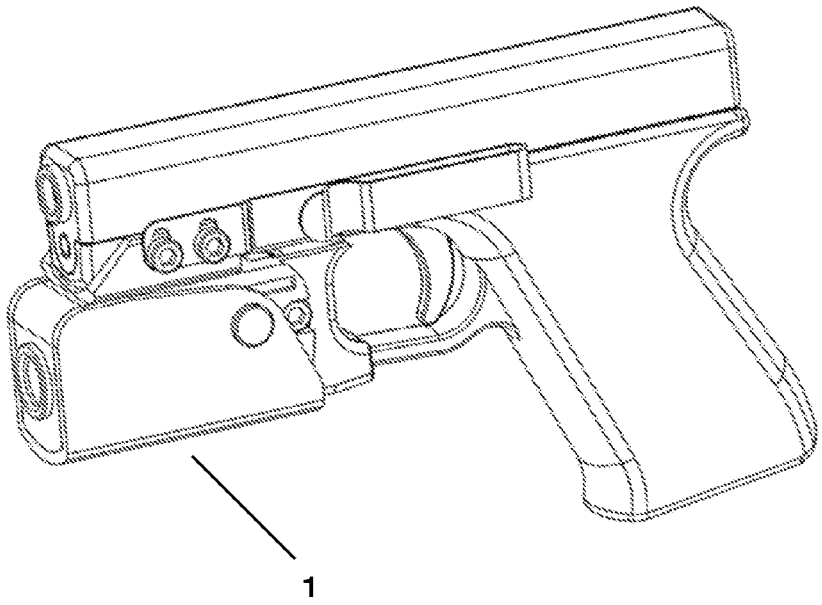
FIG. 17 is a perspective view showing the mounting assembly attached to the trigger guard and the trigger safety device is attached to the handgun in the position exposing the trigger. This mounting assembly is configured to secure the rotating trigger-lock on the handgun. In this figure, the securing screw for the mounting assembly is used to affix the trigger safety device thereto.
Figure 18:
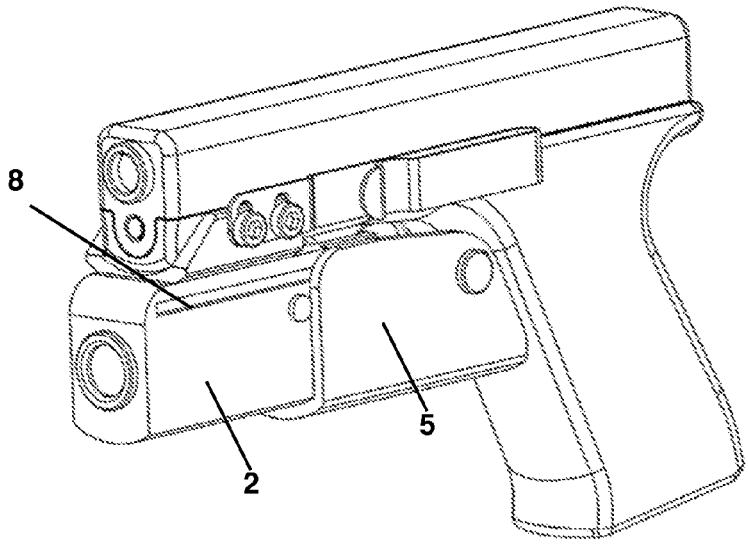
FIG. 18 is a perspective view showing the mounting assembly attached to the trigger guard and the trigger safety device is in a covering relationship with the gun trigger. This accessory is configured to secure the trigger safety device on the handgun. In this figure, the securing screw for the mounting assembly is used to affix the trigger safety device thereto.
Figure 19:
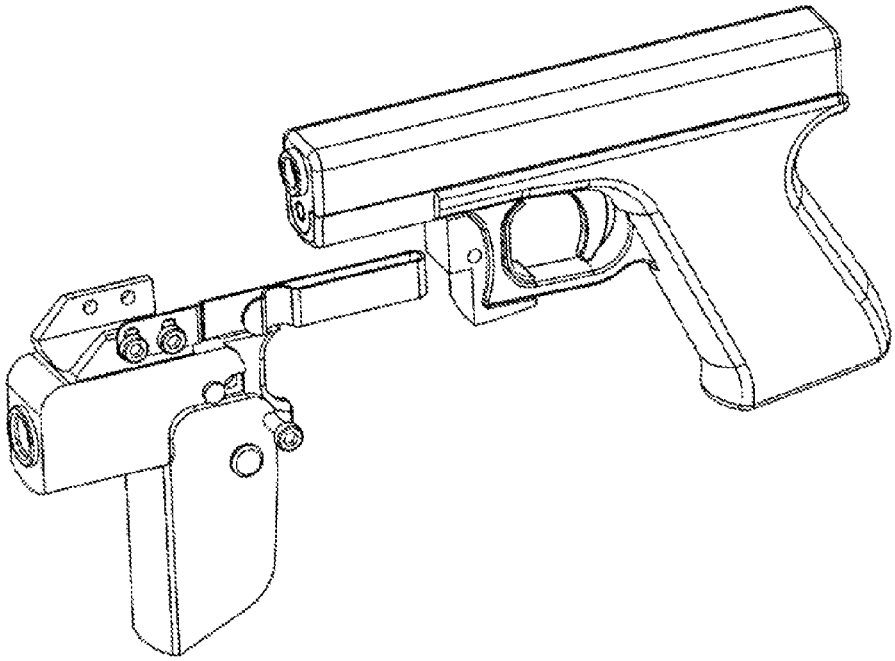
FIG. 19 is a perspective view showing the mounting assembly attached to the trigger guard and the swivelable trigger safety device is detached from the handgun. This mounting assembly is configured to secure the trigger safety device on the handgun.
Figure 20:
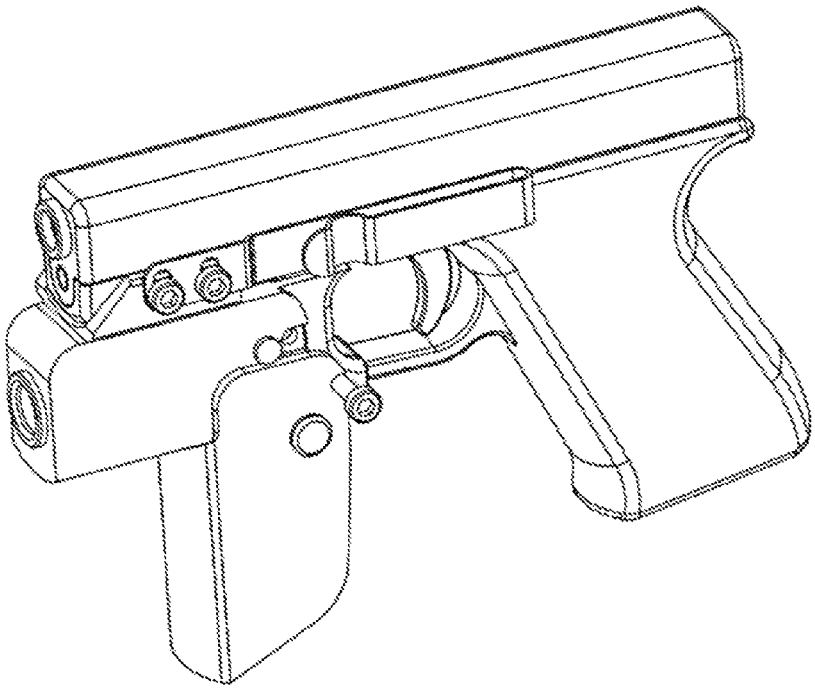
FIG. 20 is a perspective view showing the mounting assembly attached to the trigger guard and the swivelable trigger safety device is attached to the handgun in the position exposing the trigger. This mounting assembly is configured to secure the swivelable trigger safety device on the handgun. In this figure, the securing screw for the mounting assembly is used to affix the swivelable trigger safety device thereto.

For guns that do not have available Picatinny rails thereon (FIGS. 8-12 and 15-20), screws 11 can be used to secure the trigger safety device onto the gun barrel. In this configuration, a set of screw holes 12 is disposed on the two sides (left and right) of the mount. With the screws tightened on both of the sides of the gun, the trigger safety device is secured on to it. A belt clip 24 or other structure for carrying the gun can be affixed on the gun along with the trigger safety device via the screw holes (FIGS. 8-10). Other fastening structures such as a strip, a projection may be used to secure the device to the gun. To further secure the trigger safety device a mounting assembly 13 is attached to the front side of the trigger guard 14 of a gun. The mounting assembly comprises a groove 15 in a wrapping relationship with the front portion of the trigger guard and a screw hole 16 disposed outside of the trigger guard (FIGS. 13-14). The screw hole is aligned with a screw hole 17 disposed on the proximal end of the first component and a screw 18 is turned into the screw holes to further secure the trigger safety device on to the gun (FIGS. 16-17).

Figure 5:
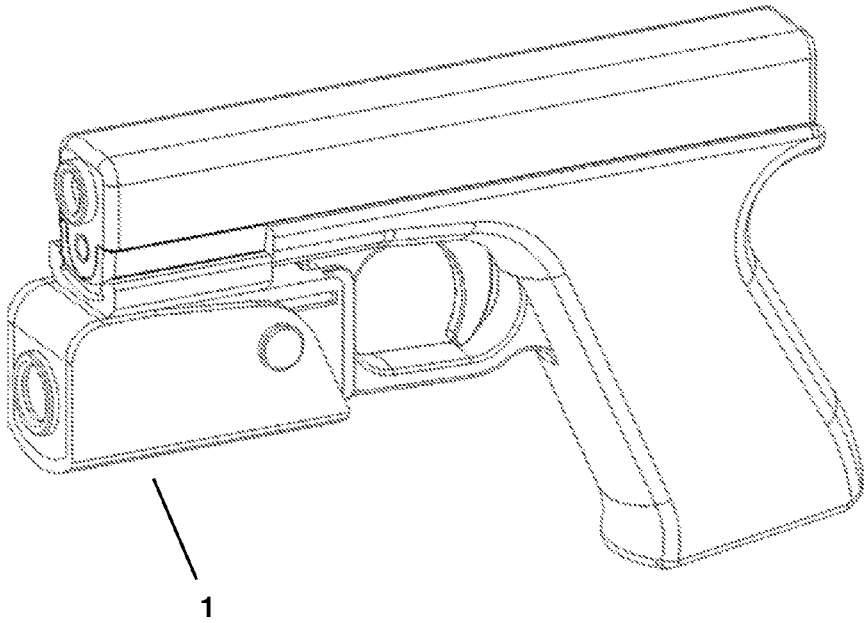
FIG. 5 is a perspective view of a trigger safety device attached on a handgun in an unlocked position.
Figure 6:
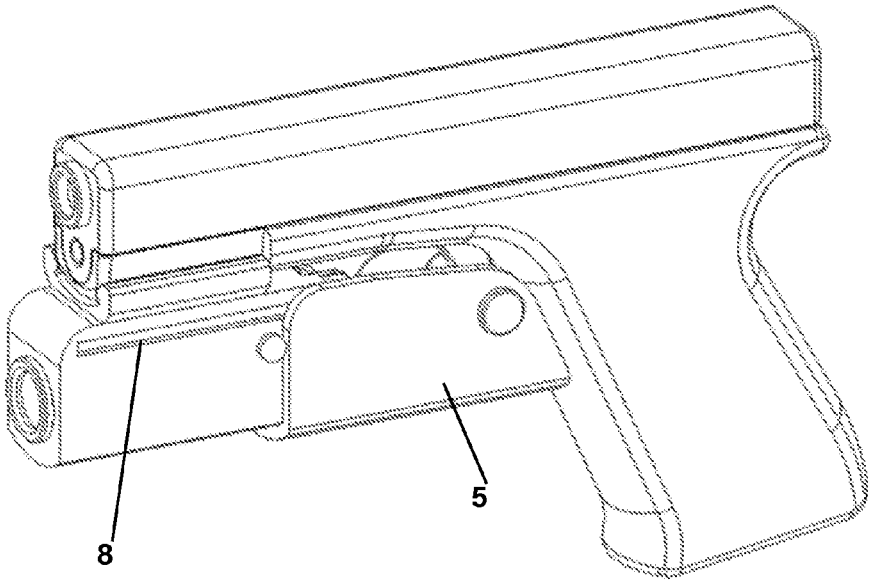
FIG. 6 is a perspective view of a trigger safety device attached on a handgun in a locked position.
Figure 7:
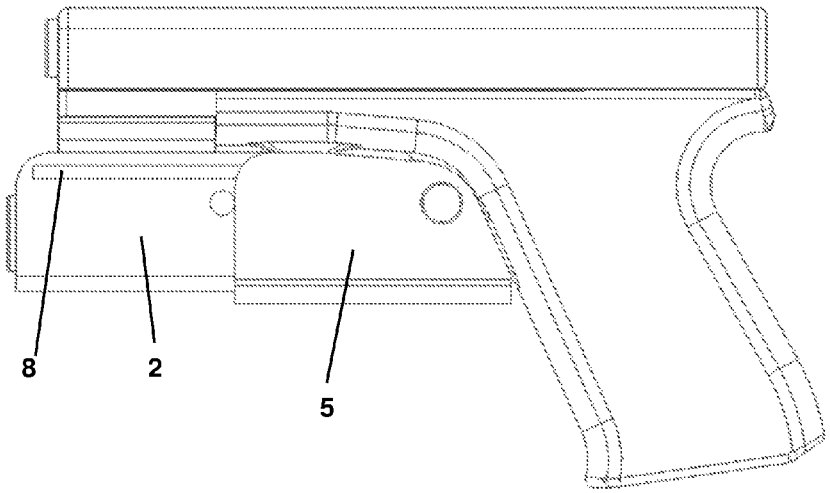
FIG. 7 is a front view of a trigger safety device attached on a handgun in a locked position.

The second component shown in the figures is closed on the bottom, left and right surfaces. A set of grooves 19, in which the rails on the first component slide, is disposed in the inner surface of the left and right side of the second component, allowing the second component to slide back and forth along the first component. When the second component slides toward the handle of the gun (FIG. 6), the trigger is covered or enclosed therein. The second component slides away from the gun handle to expose the trigger (FIG. 5). Means for limiting the position of second component may comprise a compressible position limiting rod 20 disposed at the proximal end of the first component, spanning through the depth thereof, a set of openings 21 disposed on the distal and proximal ends of the second component of the trigger safety device, a set of buttons 22 disposed over these openings and affixed on the outer surface of the second component. When the trigger safety device is in the unlocked position, the position-limiting rod enters the openings on the second component and stops any movement of the second component. If the user needs to lock the trigger, he or she just push the button over the openings on the proximal end of the second component to compress the position-limiting rod and push the rod out of the opening. The second component becomes free to move along on the first component until the openings at the distal end of second component align with the compressible position-limiting rod, which enters the openings and stops the movement of the second component at the locked position. An elastic device such as a spring may be used, if desired, to provide a pre-installed force to facilitate the switching from the locked to the unlocked position.

The second configuration of the trigger safety device comprises a rotating trigger safety device (FIGS. 8-12, 19 and 20). This trigger safety device comprises a first component 2 that mounts on or affixes to a gun barrel, a second component 5 that is hinged on the first component, and means for limiting positions of the second component. The first component comprises a body portion and a mount portion affixed on top of the body portion. A set of rails is formed on the top and bottom edge of the left and right sides of the body portion. The configuration of the mount portion depends on the structure of the gun barrel. For guns that have a standard Picatinny rails on the left and right sides of the barrel, the mount can be a simple holder attached to the bottom part and left and right sides of the barrel with grips into which the Picatinny rails 9 fit, securing the first component on to the gun. In this configuration, the trigger safety device can be easily slid onto the gun.

For guns that do not have available Picatinny rails thereon, screws can be used to secure the trigger safety device onto the gun barrel. In this configuration, a set of screw holes is disposed on the two sides (left and right) of the mount. With the screws tightened on both of the sides of the gun, the trigger safety device is secured on to it. To further secure the trigger safety device a mounting assembly is attached to the front side of the trigger guard of a gun. The mounting assembly comprises a groove in a wrapping relationship to the trigger guard and a screw hole disposed outside of the trigger guard. The screw hole is aligned with a screw hole disposed on the proximal end of the first component and a screw is turned into the aligned screw holes to further secure the trigger safety device on to the gun.

The second component is closed on the bottom, left and right surface. The distal end of the second component is hinged onto the proximal end of the first component. In a locked position, the second component rotates around the hinge 23 and encloses the trigger therein. In a position uncovering the trigger, the second component swivels around the hinge away from the trigger to allow the access thereto. Means for releasably limiting the position of second component may comprise a compressible position limiting rod and/or a button disposed at the proximal end of the first component, spanning through the depth thereof, a set of openings disposed on the distal end of the second component of the trigger safety device, a set of buttons disposed over these openings and affixed on the outer surface of the second component. When the trigger safety device is in the locked position, the position-limiting rod or buttons enter the openings on the second component and stops any movement of the second component. If the user needs to lock the trigger, he or she pushes the button over the openings on the proximal end of the second component to compress the position-limiting rod and push the rod out of the opening. The second component becomes free to rotate around the hinge until the motion is stopped by the first component. A spring may be used to provide pre-installed force to facilitate the switching from the locked to the unlocked position.

In yet another preferred embodiment, the present invention comprises other devices, such as a camera, a laser pointer or a flashlight. Preferably, the devices can be installed within the body portion of the first component, adding other functionalities to the detachable trigger safety device. Alternatively, the devices can be attached or affixed to the first component.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A trigger safety device for covering a gun trigger, comprising:

a first component removably attached to a distal end of a gun frame comprising a body portion and a mount disposed thereon;

a second component movably attached to said first component in a removably covering relationship with the gun trigger;

a sliding mechanism such that the second component is slidable on the first component along the length thereof; and a compressible position limiting rod disposed at the proximal end of the first component, spanning the depth thereof;

one or more openings disposed on a distal end and a proximal end of the second component; and one or more buttons disposed over these openings and affixed on an outer surface of the second component configured to compress said compressible position limiting rod and release said second component, wherein said position limiting rod aligns with the openings on the distal end of the second component to lock the second component in a covering relationship with the gun trigger; said position limiting rod aligns with the openings on the proximal end of the second component to lock the second component in a covering relationship with said first component.

2. The trigger safety device of claim 1, wherein said mount of the first component comprises a bottom surface configured to cover the bottom of the distal end of the gun frame, two side surfaces of the gun barrel and a fastening structure configured to secure the mount to the distal end of the gun frame.

3. The trigger safety device of claim 2, wherein said fastening structure comprises one or more grooves that fits rails on the distal end of the gun frame, one or more projections, one or more rails that grips on the rails on the distal end of the gun frame, screw holes on a side surface of the mount or a combination thereof.

4. The trigger safety device of claim 2, the fastening structure further comprising a mounting assembly comprising a groove in a wrapping relationship with a front portion of a trigger guard and affixed thereto.

5. The trigger safety device of claim 3, wherein when said fastening structure is one or more screw holes, and the mount is affixed to said gun via the screw holes.

6. The trigger safety device of claim 1, further comprising a belt clip.

7. The trigger safety device of claim 1, said sliding mechanism comprising one or more rails and grooves combinations disposed on one or more side surfaces of first component and one ore more inner surfaces of the second component.

8. A slidable trigger safety device, comprising:

a first component removably attached to a distal end of a gun frame comprising a body portion and a mount disposed thereon;

a second component attached to said first component in a removably covering relationship with a gun trigger;

a sliding mechanism for the second component to slide on the first component along the length thereof; and a compressible position limiting rod disposed at a proximal end of the first component, spanning through the depth thereof;

one or more openings disposed on a distal end and a proximal end of the second component of the trigger safety device; and one or more buttons disposed over said openings and affixed on an outer surface of the second component configured to compress said compressible position limiting rod and release the second component, wherein said position limiting rod aligns with the openings on the distal end of the second component to lock the second component in a covering relationship with the trigger, said position limiting rod aligns with the openings on the proximal end of the second component to lock the second component in a covering relationship with said first component.

9. The slidable trigger safety device of claim 8, wherein said sliding mechanism comprises one or more rails and grooves combinations disposed on side surfaces of the first component and inner surface of the second component.

10. The sliding trigger safety device of claim 8, wherein said mount of the first portion comprises a bottom surface in a covering relationship with a bottom of the distal end of the gun frame, two side surfaces and a fastening structure configured to secure the mount to side surfaces of the distal end of the gun frame.

11. The slidable trigger safety device of claim 10, wherein said fastening structure comprises one or more grooves that fits rails on the distal end of the gun frame, one or more projections, one or more rails that grips on the rails on the distal end of the gun frame, one or more screw holes on the side surfaces, strips or a combination thereof.

12. The trigger safety device of claim 11, wherein when said fastening structure is one or more screw holes, a belt clip and the mount is affixed to said gun via the screw holes.

13. The slidable trigger safety device of claim 11, said fastening structure further comprising a mounting assembly comprising a groove in a wrapping relationship with a front portion of a trigger guard and affixed thereto.

14. The trigger safety device of claim 8, further comprises a belt clip securable on the distal end of the gun frame.

15. A swivelable trigger safety device, comprising:

a first component removably attached to a distal end of a gun frame comprising a body portion and a mount disposed thereon;

a second component hingedly attached to said first component in a removably covering relationship with a gun trigger; and a compressible position limiting rod and disposed at a proximal end of the first component, spanning the depth thereof;

one or more openings disposed on a distal end of the second component of the trigger safety device; and one or more buttons disposed over these openings and affixed on an outer surface of the second component configured to compress said compressible position limiting rod and release said second component, wherein said position limiting rod aligns with the openings on the distal end of the second component to lock the second component in a covering relationship with the gun trigger.

16. The swivelable trigger safety device of claim 15, wherein said mount of the first component comprises a bottom surface in a covering relationship with a portion of a bottom of the distal end of the gun frame, two side surfaces and a fastening structure configured to secure the mount to the gun barrel.

17. The swivelable trigger safety device of claim 16, wherein said fastening structure comprises one or more grooves that fits rails on the distal end of the gun frame, one or more projections, one or more rails that grips on the rails on the distal end of the gun frame, screw holes on side surfaces, strips structures or a combination thereof.

18. The swivelable trigger safety device of claim 17, wherein when said fastening structure is one or more screw holes, a belt clip and the mount is affixed to said gun via the screw holes.

19. The swivelable trigger safety device of claim 17, said fastening structure further comprising a mounting assembly comprising a groove in a wrapping relationship with a front portion of a trigger guard and affixed thereto.

20. The swivelable trigger safety device of claim 15, further comprises a belt clip removably secured on the distal end of the gun frame.

* * * * *